US007549834B2

(12) United States Patent
Kirchhof et al.

(10) Patent No.: US 7,549,834 B2
(45) Date of Patent: Jun. 23, 2009

(54) ACTUATION PRESSURE CONTROL FOR ADJUSTABLE SEALS IN TURBOMACHINERY

(75) Inventors: Darrin Glen Kirchhof, Schenectady, NY (US); William Charles Below, Clifton Park, NY (US); Mark Edward Burnett, Buskirk, NY (US); Frederick George Baily, Ballston Spa, NY (US); Shorya Awtar, Clifton Park, NY (US); Norman Arnold Turnquist, Sloansville, NY (US)

(73) Assignee: General Electric Company, Schenectady, NY (US)

( * ) Notice: Subject to any disclaimer, the term of this patent is extended or adjusted under 35 U.S.C. 154(b) by 544 days.

(21) Appl. No.: 11/454,836

(22) Filed: Jun. 19, 2006

(65) Prior Publication Data

US 2007/0292258 A1 Dec. 20, 2007

(51) Int. Cl.
*F01D 11/02* (2006.01)

(52) U.S. Cl. ..... 415/1; 415/113; 415/174.1

(58) Field of Classification Search ..... 277/413; 415/113, 174.1, 174.5

See application file for complete search history.

(56) References Cited

U.S. PATENT DOCUMENTS

| | | | | |
|---|---|---|---|---|
| 5,667,224 | A | 9/1997 | Streckert et al. | |
| 6,502,823 | B1 | 1/2003 | Turnquist et al. | |
| 6,572,115 | B1 | 6/2003 | Sarshar et al. | |
| 6,655,696 | B1 | 12/2003 | Fang et al. | |
| 6,786,487 | B2 | 9/2004 | Dinc et al. | |
| 7,066,470 | B2 | 6/2006 | Turnquist et al. | |
| 2004/0126222 | A1 * | 7/2004 | Addis | 415/1 |
| 2008/0267770 | A1 * | 10/2008 | Webster et al. | 415/173.1 |

* cited by examiner

*Primary Examiner*—Richard Edgar
(74) *Attorney, Agent, or Firm*—Nixon & Vanderhye P.C.

(57) ABSTRACT

An actuation pressure control system effects actuation of adjustable seal segments between stationary and rotating turbomachinery members. At least one actuator is coupled with each of the adjustable seal segments and controls a position of the seal segments, respectively. A pressure system is disposed within the turbomachinery that measures or estimates ambient pressure representing an actuator back pressure acting against the actuator. A pressure regulator via a controller pressurizes the actuator to a level sufficient for a desired seal operation and controls actuator pressure based on the actuator back pressure.

15 Claims, 4 Drawing Sheets

ACTUATION PRESSURE CONTROL FOR ADJUSTABLE SEALS IN TURBOMACHINERY

BACKGROUND OF THE INVENTION

The present invention relates generally to rotary machines and, more particularly, to actuated seals for rotary machines.

Rotary machines include, without limitation, steam turbines, gas turbines, and compressors. A steam turbine has a steam path that typically includes, in serial-flow relationship, a steam inlet, a turbine, and a steam outlet. A gas turbine has a gas path which typically includes, in serial-flow relationship, an air intake (or inlet), a compressor, a combustor, a turbine, and a gas outlet (or exhaust nozzle). Gas or steam leakage, either out of the gas or steam path or into the gas or steam path, from an area of higher pressure to an area of lower pressure, is generally undesirable. For example, a gas path leakage in the turbine or compressor area of a gas turbine, between the rotor of the turbine or compressor and the circumferentially surrounding turbine or compressor casing, will lower the efficiency of the gas turbine leading to increased fuel costs. Also, steam-path leakage in the turbine area of a steam turbine, between the rotor of the turbine and the circumferentially surrounding casing, will lower the efficiency of the steam turbine leading to increased fuel costs.

It is known in the art of steam turbines to position, singly or in combination, labyrinth-seal segments with or without brush seals, in a circumferential array between the rotor of the turbine and the circumferentially surrounding casing to minimize steam-path leakage. Springs hold the segments radially inward against surfaces on the casing that establish radial clearance between the seal and rotor but allow segments to move radially outward in the event of rotor contact. While labyrinth seals, singly or in combination with brush seals, have proved to be quite reliable, labyrinth-seal performance degrades over time as a result of transient events in which the stationary and rotating components interfere, rubbing the labyrinth teeth into a "mushroom" profile and opening the seal clearance.

One means of reducing the degradation due to rubbing has been to employ "positive-pressure" variable-clearance labyrinth packings, in which springs are used to hold the packing-ring segments open under the no- or low-flow conditions during which times such rubbing is most likely to occur. Ambient steam forces overcome the springs at higher load acting to close the rings to a close running position. However, it would be desirable to provide an "actively controlled" variable-clearance arrangement in which the packing-ring segments are held open against springs and steam force by internal actuators, during the conditions under which rubbing is most likely to occur. At the operating conditions under which rubbing is unlikely, actuator force could be reduced, permitting the springs and steam forces to move the segments to their close running position.

In order to actuate such 'active' or 'adjustable' seals against the steam force, high pressures within the actuators are often required. Additionally, in certain situations when the seals need to be opened quickly, high pressure must be built up inside the actuators in a very short period of time. Problems arise, however, in that excessively high pressure differentials in the actuators tend to reduce their useful life. Additionally, due to compressibility of the actuating medium, such as the case with air or other gases or liquid, the time that it takes to build the pressure inside the actuators may be longer than what is desired to actuate, and thereby protect, the seals. Additionally, in certain situations when the turbine steam pressure falls, it is desirable to depressurize the actuators accordingly to avoid excess pressure in the actuators with respect to the ambient steam pressure. Due the compressibility of the actuating medium, if this venting process takes too long, the excess pressure in actuators may reduce their useful life.

BRIEF DESCRIPTION OF THE INVENTION

In an exemplary embodiment of the invention, actuation of adjustable seal segments between stationary and rotating turbomachinery members is actively controlled. Each of the adjustable seal segments is coupled with at least one actuator that controls a position thereof. The method includes the steps of monitoring or estimating ambient pressure within the turbomachinery, the ambient pressure representing an actuator back pressure acting against the actuator, and pressurizing the actuator to a level sufficient for a desired seal operation (such as open or close) and controlling actuator pressure based on the actuator back pressure.

In another exemplary embodiment of the invention, an actuation system actuates adjustable seal segments between stationary and rotating turbomachinery members. The system includes at least one actuator coupled with each of the adjustable seal segments, the actuator controlling a position of the seal segments, respectively. At least one pressure system is disposed within the turbomachinery, the pressure system either measuring or estimating ambient pressures within the turbomachinery, where the ambient pressures represent an actuator back pressure acting against the actuator. A controller determines an actuation pressure based on a desired seal operation (such as open or close), and a pressure regulator communicating with the controller and the pressure system and in fluid communication with the actuator, pressurizes the actuator to the actuation pressure (e.g., using an air supply) and controls actuator pressure based on the actuator back pressure.

DETAILED DESCRIPTION OF THE INVENTION

Figure 1:
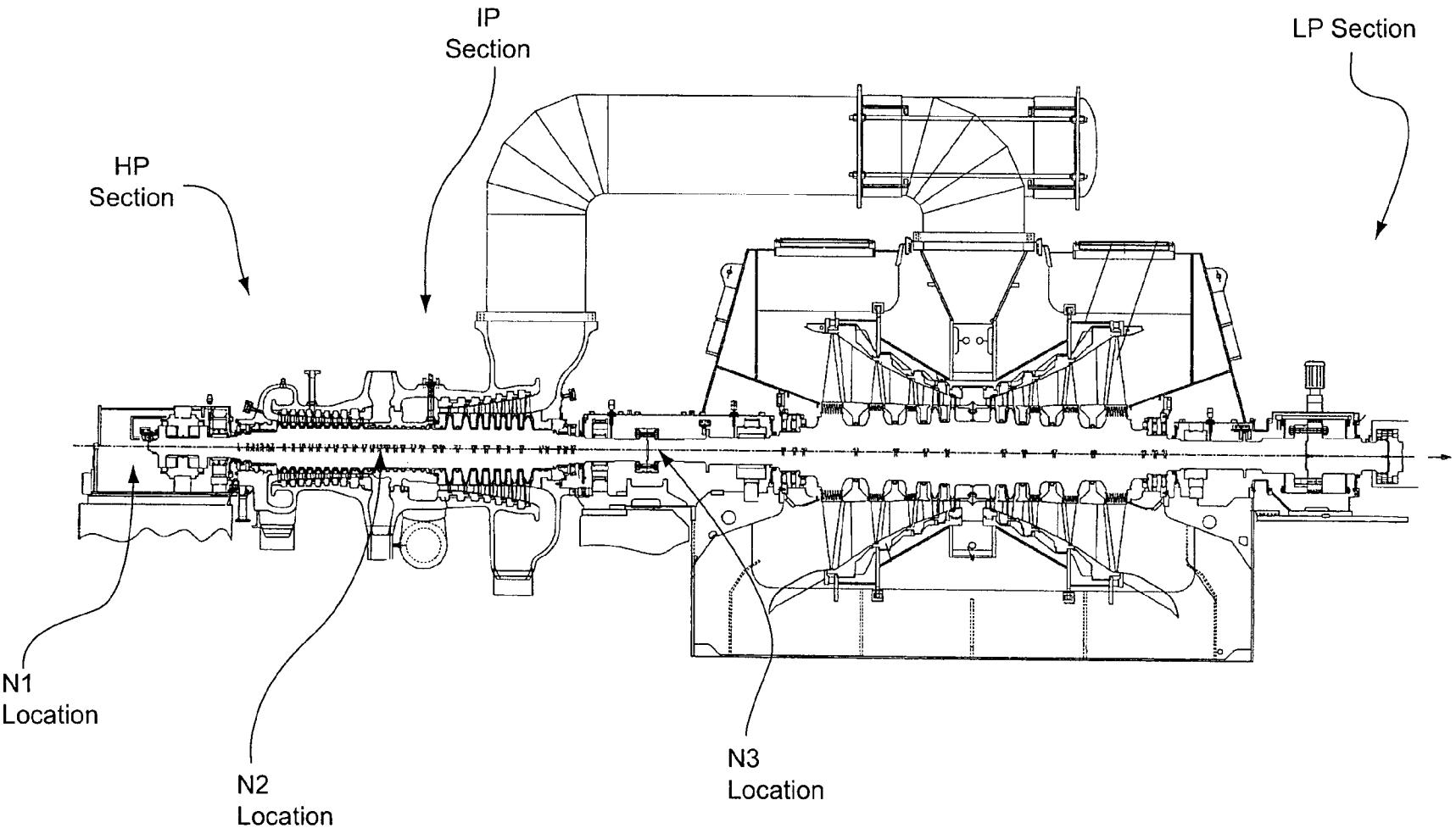
FIG. 1 illustrates a typical steam turbine.

FIG. 1 illustrates a typical steam turbine as an exemplary rotary machine. Between shaft-packing location numbers N1, N2, and N3, the turbine includes sections of varying pressures including a high-pressure section (HP), and an intermediate-pressure section (IP). (A low-pressure section (LP) is employed in a second casing, between packings N4 and N5.) In this case, the N2 packing is contained in a packing head contained within the combined HP-IP shell (or casing).

Figure 2:
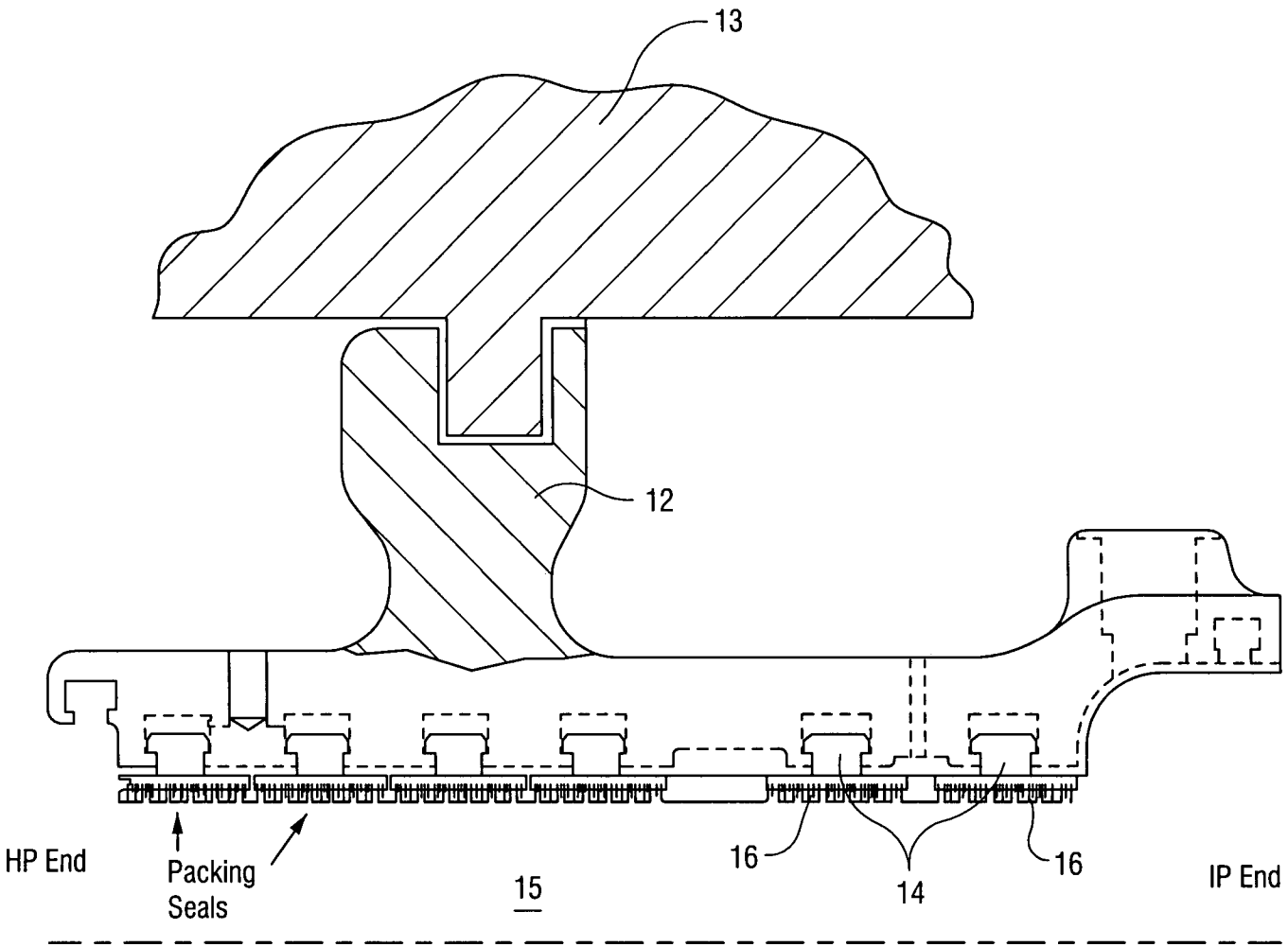
FIG. 2 shows an exemplary application of the seals within the number 2 (N2) packing of a typical steam turbine, where the packing rings are contained within a packing head, in turn located within the shell (casing) of the combined high-pressure (HP) and intermediate pressure (IP) sections.

FIG. 2 is a partial cross-sectional view of an N2 packing head 12 that is contained within the shell 13, and disposed surrounding a rotating member, such as a rotor 15. The N2 packing head 12 includes a plurality of packing rings made up of ring segments 14 that serve to seal close to the rotating member 15. The packing rings are typically defined with six 60° segments, for example. The radial inner surface that faces the rotating member is provided with teeth members 16 of different heights that define a difficult path or labyrinth seal to prevent steam from leaking along the shaft. As discussed above, transient events may occur within the turbine where the stationary and rotating components come in unwanted contact, thereby rubbing the labyrinth teeth 16, opening the seal clearance, and blunting the sharp tips of the teeth out of functionality.

Figure 3:
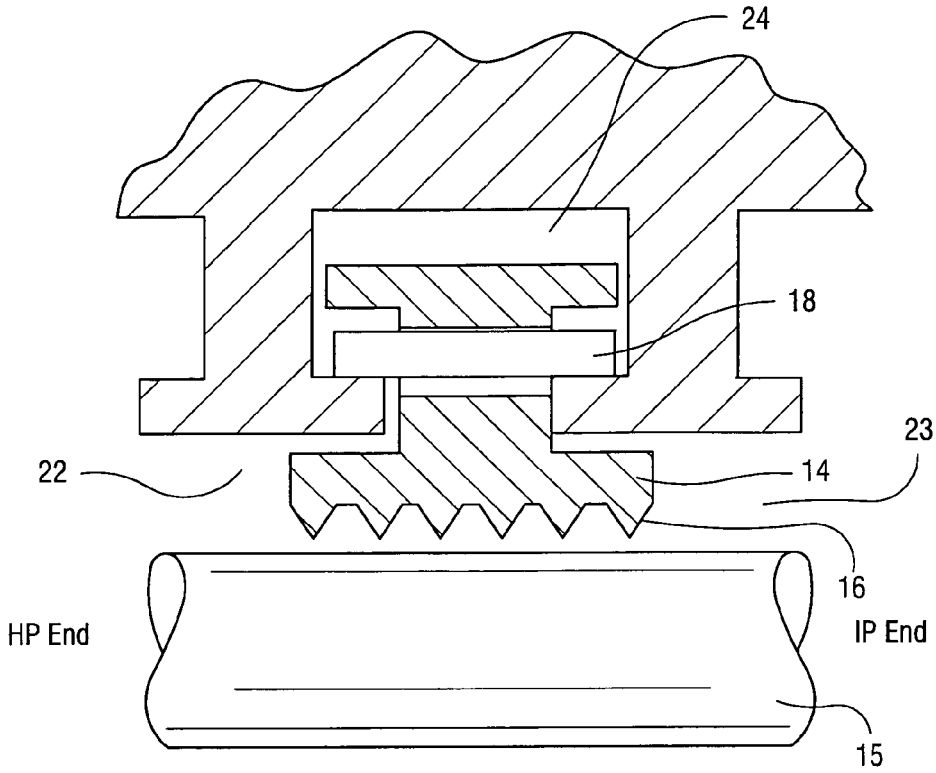
FIG. 3 is a view of the N2 packing head shown in FIG. 2, with the actuators depressurized and retracted.
Figure 4:
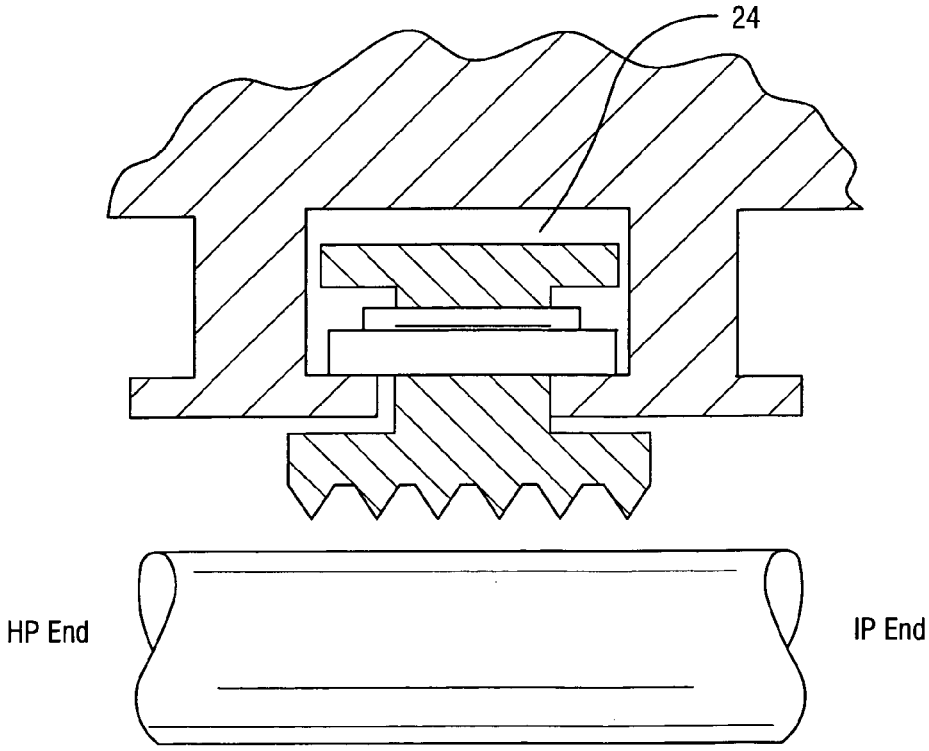
FIG. 4 is a view of the N2 packing head with the actuators pressurized and extended.

Technology exists for the pneumatic actuation of the seal segments 14 close to and away from the rotating member to thereby protect the seals from rubbing and improve machine performance. With reference to FIG. 3, adjustable seal segments 14 are coupled with actuators 18 that control a position of the seal segments 14. Each of the seal segments 14 may be opened or held open by the actuators 18 such that the seal segments 14 are retracted to a radially outermost position (FIG. 4), or the seal segments 14 may be closed or held closed by spring force and steam pressure (FIG. 3) such that the seal segments 14 are disposed in a radially innermost position in which the teeth 16 of the segments 14 are close to the rotating member 15.

Figure 5:
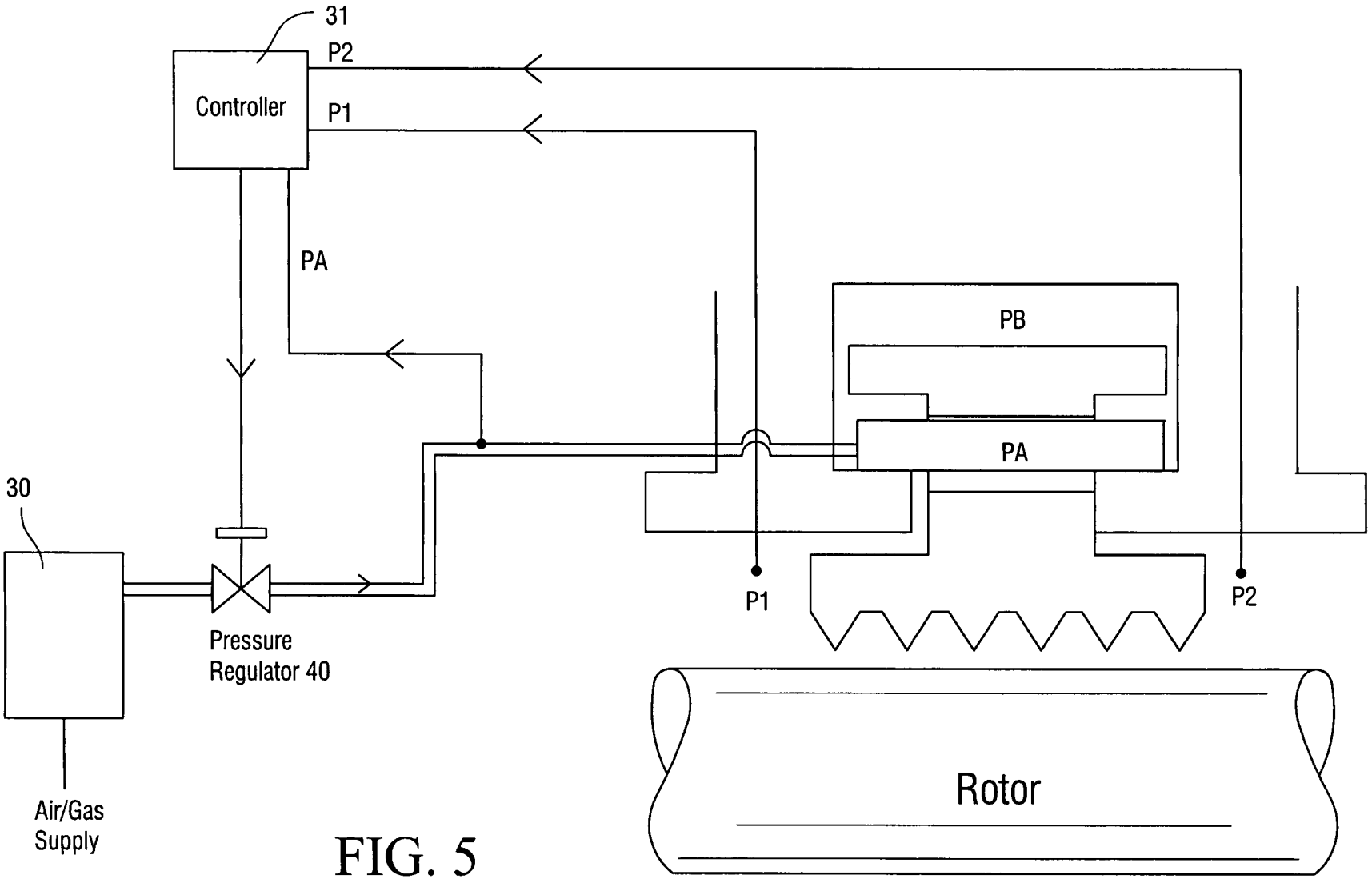
FIG. 5 is a schematic illustration of the control system and hardware for actuating medium supply and pressure regulation.

FIG. 5 is a schematic illustration of the system and hardware for air supply and pressure control. An air supply 30 provides pressurized air or gas to a pressure regulator 40. The actuators 18 are illustrated schematically. In a preferred arrangement, there are three actuators 18 for each seal segment 14 and thus eighteen actuators for each packing ring. It is possible that as few as one actuator per segment would be sufficient for some applications.

Without pressure in the machinery, a spring or set of springs biases the seal segments 14 close to the rotating member 15, a position referred to as the closed condition. During use, a significant steam pressure develops in the areas 22 and 23, upstream and downstream respectively, of the packing ring segments 14 (FIG. 3), which are the ambient pressures within the turbomachinery. These pressures are labeled as P1 and P2 in FIG. 5. In a forward flow condition, when the seal segment is biased towards the right, the area 24 behind the seal segment sees pressure P1. In a reverse flow condition, when the seal segment is biased towards the left, the area 24 behind the seal segments sees pressure P2.

The pressure in area 24 represents the actuator back pressure acting against the actuator 18. In a preferred embodiment, the ambient pressures are directly measured via suitable pressure measuring devices such as pressure transducers and monitored via a controller 31, such as a CPU or the like. In an alternate embodiment, these ambient pressures may be indirectly estimated by the controller. In either case, based on the ambient pressures, the controller sends an appropriate command to the pressure regulator 40, which in turn pressurizes the actuators 18 to a level sufficient for a desired seal operation (open, keep open, close, or keep closed) such that the actuators 18 are never over-pressurized, a condition when the actuator pressure is in excess of what is needed for a certain seal operation, or excessively reverse-pressurized, a condition when the actuator pressure falls significantly below the back pressure. Both of these conditions can lead to premature failure of the actuators 18 either statically or dynamically. The pressure regulator 40 controls the actuator pressure using a feedback loop that provides an actuator pressure measurement or estimate.

The controller 31 also detects sudden changes in the machine operating conditions such as a trip. During a full-load trip, the controller sends a command to the pressure regulator 40 to maintain the prior pressure in the actuators 18. As the ambient pressures, and therefore the actuator back pressure, drop during the machine trip, the seals self-actuate. That is, with constant internal pressure, and falling back pressure, a pressure differential develops across the actuators leading them to actuate, thus opening the seals. This avoids the need for the pressure regulator 40 to admit actuating medium, such as air or other gas or liquid, into the actuator 18 to increase the pressure in a very short time, which may not be feasible given the compressibility of the actuation medium. This self-actuation scheme significantly alleviates the risk of over-pressurization of the actuators 18 during machine trips, is robust against any pressure dependent shell deformation behavior, moving the seal segments 14 out of the way fast enough despite the finite response time of the pressure regulator 40, and is benign on the actuators 18.

The actuator pressurization level is preferably determined according to a formula based on an operating condition of the turbomachinery and the actuator back pressure. For example, if the operating condition dictates that the seal segments 14 should be held closed, the actuator pressurization level (PA) is determined as PA=PB+K1(psi), where PB is the actuator back pressure and K1 is a constant. Alternatively, if the operating condition dictates that the seal segments 14 should be opened from a closed state, the actuator pressurization level (PA) is determined as PA=PB+K2*($P_{drop}$), where PB is the actuator back pressure, K2 is a constant, and $P_{drop}$ is a pressure drop across the seal segment 14. For a forward flow condition, PB is the same as P1, and $P_{drop}$=P1−P2. For a reverse flow condition PB=P2, and $P_{drop}$=P2−P1. In general, the constant K2 may assume different values depending upon the operating condition.

As referenced above, in the event of a trip, the actuator pressure is controlled so as to allow the actuators to self-actuate and open the seal segments in a timely fashion. Once a trip has occurred and the packing seals have opened, the controller 31 maintains the actuator pressure sufficiently higher than the actuator back pressure to keep the seal segments 14 open as the ambient pressures and actuator back pressure drop after the trip. The concept of self-actuation is independent on the pneumatic response time.

In a scheduled shut down, unlike a trip, the control system 31 preferably opens the seal segments 14 when the ambient pressures, and therefore the actuator back pressure, drop below a predetermined level. During machine start up, the seal segments 14 are maintained open until at least one or more of the following exemplary criteria are met (1) a predetermined time has elapsed, (2) the machine has reached its rated RPM, (3) steady state load has been reached, and (4) any thermal transients have subsided. In general, there may be other criteria, not mentioned above, that may be considered.

The condition for seal opening may alternatively or additionally be determined by having a position sensor that measures the rotor radial position with respect to the stator, measuring a radial clearance between the stator and rotor. If this clearance falls below a predetermined distance, the control system can trigger opening of the seal segments.

The control system 31 not only determines the appropriate actuation pressure for the actuators 18, it also monitors the health of the actuation system. Since the control system 31 senses ambient pressures P1 and P2 continuously, it can determine whether seal segments 14 open or close as expected. For example, if in a certain condition the seal segments 14 open as commanded, ambient pressures P1 and P2 should change in a predictable fashion. This information is programmed into the control system 31, which allows the control system 31 to determine that the seal segments 14 are not opening as commanded if P1 and P2 deviate from their expected behavior.

With the pressure control system and method of the invention, over-pressurization and excessive reverse pressurization of the actuators are avoided, thereby increasing actuator useful life. Additionally, self-actuation during machine shut down enables timely control of seal position. Although the invention is described with reference to an exemplary application to steam turbines, it will be appreciated that the concepts herein are applicable to all turbomachinery including without limitation steam turbines, gas turbines, air-craft engines, etc.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of controlling actuation of adjustable seal segments between stationary and rotating turbomachinery members, each of the adjustable seal segments being coupled with at least one actuator that controls a position thereof, the method comprising:

monitoring or estimating ambient pressure within the turbomachinery, the ambient pressure representing an actuator back pressure acting against the actuator; and pressurizing the actuator to a level sufficient for a desired seal operation and controlling actuator pressure based on the actuator back pressure, wherein if the desired seal operation is to keep open the seal segments, the pressurizing step is practiced by maintaining actuator pressure higher than the back pressure.

2. A method according to claim 1, wherein the actuator is biased toward a position in which the seal segments are closed, and wherein the pressurizing step is practiced by pressurizing the actuator such that a predefined pressure differential exists between the actuator pressurization level and the back pressure depending on the desired seal operation.

3. A method according to claim 1, wherein the actuator pressurization level is determined according to a formula based on an operating condition of the turbomachinery and the actuator back pressure.

4. A method according to claim 3, wherein if the operating condition dictates that the seal segments should be held closed, the actuator pressurization level (PA) is determined as PA =PB +K1 (psi), where PB is the actuator back pressure, and K1 is a constant.

5. A method according to claim 3, wherein if the operating condition dictates that the seal segments should be opened from a closed state, the actuator pressurization level (PA) is determined as PA =PB +K2*($P_{drop}$), wherein PB is the actuator back pressure, K2 is a constant, and $P_{drop}$ is a pressure drop across the seal segment.

6. A method according to claim 1, wherein if an operating condition reflects that a trip has occurred, the method farther comprises maintaining the actuator pressurization level to open the seal segments as the actuator back pressure drops due to the trip.

7. A method according to claim 1, wherein if an operating condition reflects a scheduled shut down, the method comprises opening the seal segments when the actuator back pressure drops below a predefined level.

8. A method according to claim 1, wherein if an operating condition reflects a machine staff-up, the method comprises maintaining the seal segments open until at least one of(1) a predetermined time has elapsed, (2) the machine has reached its rated RPM, (3) steady state load has been reached, and (4) thermal transients have subsided.

9. A method according to claim 1, farther comprising monitoring operating health of the actuator and the seal segments by determining whether the seal segments are positioned as expected based on the actuator pressurization level and the turbomachinery ambient pressure.

10. An actuation system for actuation of adjustable seal segments between stationary and rotating turbomachinery members, the system comprising:

at least one actuator coupled with each of the adjustable seal segments, the actuator controlling a position of the seal segments, respectively;

at least one pressure system disposed within the turbomachinery, the pressure system either measuring or estimating ambient pressures within the turbomachinery, the ambient pressures representing an actuator back pressure acting against the actuator;

a controller that determines an actuation pressure based on a desired seal operation; and a pressure regulator communicating with the controller and the pressure system and in fluid communication with the actuator, the pressure regulator pressurizing the actuator to the actuation pressure and controlling actuator pressure based on the actuator back pressures, wherein the controller is programmed to maintain actuator pressure higher than the back pressure if the desired seal operation is to keep open the seal segments.

11. An actuation pressure control system according to claim 10, wherein the actuator is biased toward a position in which the seal segments are closed, and wherein the controller is programmed to control the pressure regulator to pressurize the actuator such that a predefined pressure differential exists between the actuator pressurization level and the back pressure depending on the desired seal operation.

12. An actuation pressure control system according to claim 10, wherein the controller is programmed to effect self-actuation of the seal segments upon machine trip.

13. An actuation pressure control system according to claim 10, comprising a gas as a pressurizing medium.

14. An actuation pressure control system according to claim 13, comprising air as the pressurizing medium.

15. An actuation pressure control system according to claim 10, comprising a liquid as a pressurizing medium.

* * * * *

UNITED STATES PATENT AND TRADEMARK OFFICE

CERTIFICATE OF CORRECTION

PATENT NO. : 7,549,834 B2
APPLICATION NO. : 11/454836
DATED : June 23, 2009
INVENTOR(S) : Kirchhof et al.

It is certified that error appears in the above-identified patent and that said Letters Patent is hereby corrected as shown below:

In the Claims:

Column 5, line 58, delete "farther" and insert --further--.

Column 6, line 9, delete "staff-up" and insert --start-up--.

Column 6, line 14, delete "farther" and insert --further--.

Column 6, line 36, delete "pressures" and insert --pressure--.

Signed and Sealed this

Fifteenth Day of September, 2009

David J. Kappos

David J. Kappos
*Director of the United States Patent and Trademark Office*